US006488166B2

(12) United States Patent
Swank et al.

(10) Patent No.: US 6,488,166 B2
(45) Date of Patent: Dec. 3, 2002

(54) IMPLOSION PREVENTION BAND FOR A CRT

(75) Inventors: Harry Robert Swank, Lancaster, PA (US); Stephen Thomas Opresko, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 21 days.

(21) Appl. No.: 09/735,875

(22) Filed: Dec. 13, 2000

(65) Prior Publication Data

US 2002/0070214 A1 Jun. 13, 2002

(51) Int. Cl.[7] ..... A04N 5/65; H01J 9/00
(52) U.S. Cl. ..... 220/2.1 R; 348/822
(58) Field of Search ..... 220/2.1 R; 313/477 R, 313/479; 29/446; 348/822

(56) References Cited

U.S. PATENT DOCUMENTS 3,220,593 A 11/1965 Powell et al. ..... 220/2.1
3,569,990 A * 3/1971 Inglis ..... 348/822
3,623,196 A * 11/1971 Bongenaar et al. ..... 348/822
3,845,530 A 11/1974 Platt ..... 29/25.13
4,356,515 A 10/1982 Sumiyoshi et al. ..... 358/246
4,415,932 A * 11/1983 Rogers ..... 348/822
5,036,577 A 8/1991 Swank ..... 29/446

* cited by examiner

*Primary Examiner*—Joseph Man Moy
(74) *Attorney, Agent, or Firm*—Joseph S. Tripoli; Dennis H. Irlbeck; Carlos M. Herrera

(57) ABSTRACT

The present invention relates to an implosion prevention band for a CRT comprising an evacuated envelope having a mask and corresponding faceplate panel with sidewalls joined to a funnel. The faceplate panel and sidewalls form external corner surfaces and a peripheral inside blend radius. An implosion prevention band surrounds and closely hugs at least an edge of the external corner surfaces of the faceplate panel. The band extends along the exterior surface of the sidewall such that the width of the band is at or near the inside blend radius of the faceplate panel. The band is under tension to produce radially inwardly directed force components through the corners of the faceplate panel and primarily near the blend radius to produce a high degree of implosion protection for the CRT.

11 Claims, 2 Drawing Sheets

IMPLOSION PREVENTION BAND FOR A CRT

The present invention relates to an implosion prevention band fitted to the external surface of a faceplate panel having reduced curvature of an evacuated and sealed cathode-ray-tube (CRT) and in particular, to a tension band wherein the width and corners of the tension band are designed to maximize the compressive forces on the panel face.

BACKGROUND OF THE INVENTION

A conventional color CRT includes a glass faceplate panel with a sidewall and a funnel sealed to the faceplate sidewall along a planar sealing interface. The CRT is evacuated to a very low pressure causing the tube to deform mechanically with resulting stresses produced by the vacuum and by the atmospheric pressure acting on all surfaces of the CRT. Accordingly, such stresses subjects the tube to the possibility of implosion as a result of an impact to the glass faceplate panel. Such impact to the glass faceplate panel can cause the panel to shatter into many fragments, projecting the glass fragments in random directions with considerable force.

The most common solution to the implosion problem is to use convexly curved faceplate panels with increased glass thickness near the edges of the faceplate panel to resist the stresses described above. In conjunction with the curved faceplate panel, it is also known to use an implosion prevention band consisting of a metal shrink band in hoop tension over, and tightly against, the faceplate sidewalls, so as to exert a radial compressive force to the sidewalls of the faceplate panel. It is also known to fasten metal strips along the straight edges of the sidewall of the curved faceplate panel underneath the metal tension shrink band. The metal strips redistribute the compression load applied by the tension band to the straight edge sides of the sidewall, so that the load is not concentrated at the corners of the faceplate panel. Normally, the shrink band extends over and covers the mold match line of the faceplate panel and the majority of the sidewall.

The curvature of the faceplate panel allows for the vacuum forces within the tube to be distributed through the faceplate panel. However, deformation of the tube also introduces tensile stresses throughout the faceplate panel and sidewalls. The bands are used to apply a compressive force to the sidewalls of the CRT to redistribute some of the faceplate panel forces. The redistribution of the faceplate forces decreases the probability of an implosion of the tube by minimizing tension forces in the sidewalls and corners of the faceplate panel. Implosion prevention bands are also beneficial because they improve the impact resistance of the tube. Glass in compression is stronger than glass which is not in compression. The band causes compression in faceplate areas which otherwise are in tension. Additionally, in the event of an implosion the redistributed stresses cause the imploding glass to be directed toward the back of the cabinet in which the tube is mounted, thereby substantially containing the glass fragments of the imploding tube.

The curved faceplate panels described above require that the mask be curved. However, television tubes having flatter viewing surfaces also employ a relatively flat mask and similarly shaped faceplate panel faces, i.e., viewing surfaces. Unfortunately, the implosion protection techniques that have been used successfully with curved faceplate panel tubes have proven inadequate when used with these CRTs having reduced curvature or completely flat faceplate panels. Flatter faceplate panels under vacuum loads still flex inwardly as a result of the vacuum pressure. However, the lack of curvature in the flatter faceplate panels causes high tensile stresses near the viewing surface of the panel. When prior art implosion protection bands are used on a flatter faceplate panel tube, the bands extend far aft of the viewing surface along the sidewall and tend to deflect the sidewall inwardly thereby increasing the tension on the viewing surface of the faceplate panel. Consequently, the prior art implosion protection bands cannot supply large enough compressive loads upon the faceplate panel. Therefore, the tensile stresses on the faceplate panel are not sufficiently reduced. Moreover, tubes having highly rectangular flat faceplate panels, such as in wide screen televisions using a 16:9 aspect ratio instead of the standard 4:3 aspect ratio of a normal square television, will be subject to additional pressure exerted on the glass along the straight edge of the sidewall with the use of such prior art bands due to the elongated sides of the panel. Consequently, the degree of implosion protection on flat faceplate panels by conventional implosion bands is greatly reduced.

SUMMARY OF THE INVENTION

The present invention relates to a shrink band that cooperates with the faceplate panel of the CRT having reduced curvature to help prevent dangerous implosions.

According to the aspect of the present invention, the CRT comprises an evacuated envelope having a mask and corresponding faceplate panel having rounded corners and a sidewalls joined to a funnel. The faceplate panel and sidewalls form an inside blend radius around the inner periphery of the faceplate panel. The band extends along the exterior surface of the sidewall such that the width of the band terminates at or near the inside blend radius of the faceplate panel. The band is under tension to produce radially inwardly directed force components primarily through the corners of the faceplate panel at or near the inside blend radius to produce a high degree of implosion protection for the CRT.

BRIEF DESCRIPTION OF THE DRAWINGS

The invention will now be described in greater detail with relation to the accompanying drawings in which.

DETAILED DESCRIPTION OF THE PREFERRED EMBODIMENT

Figure 1:
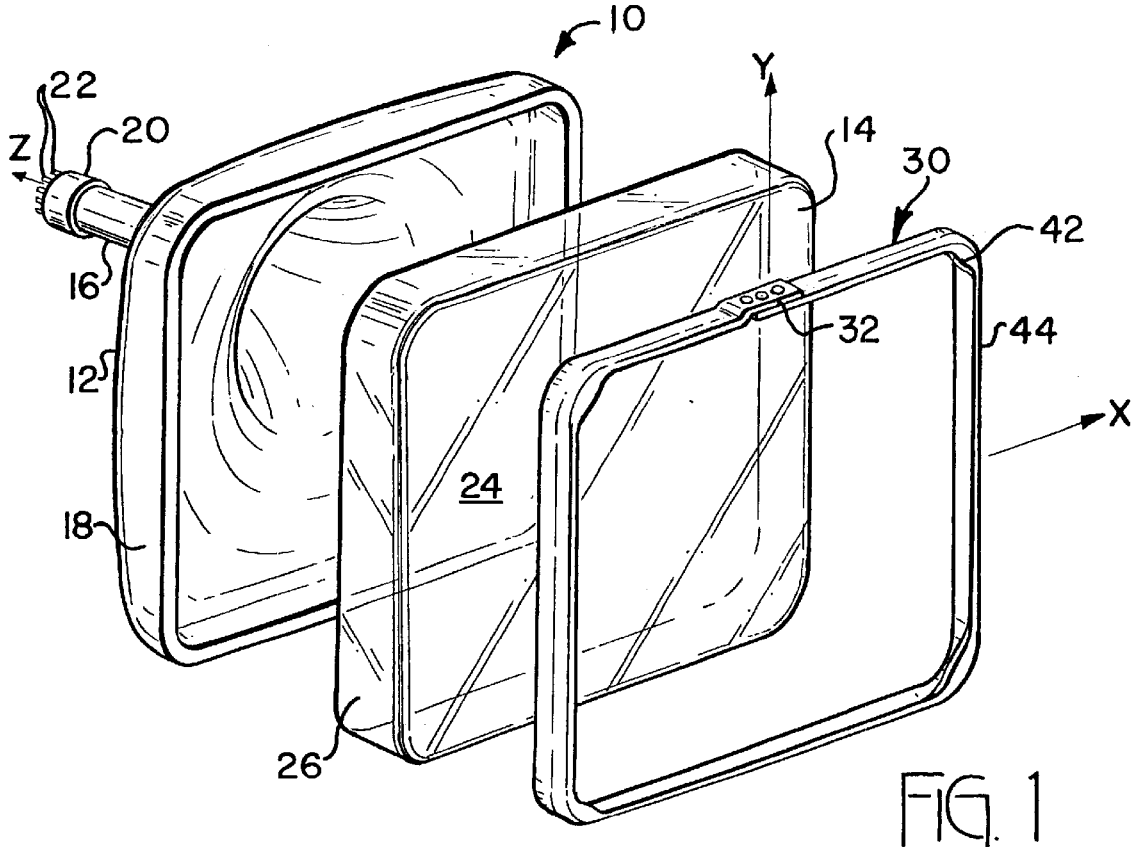
FIG. 1 is an exploded schematic perspective side view of a color cathode ray tube having the implosion prevention band of the present invention installed thereon.
Figure 2:
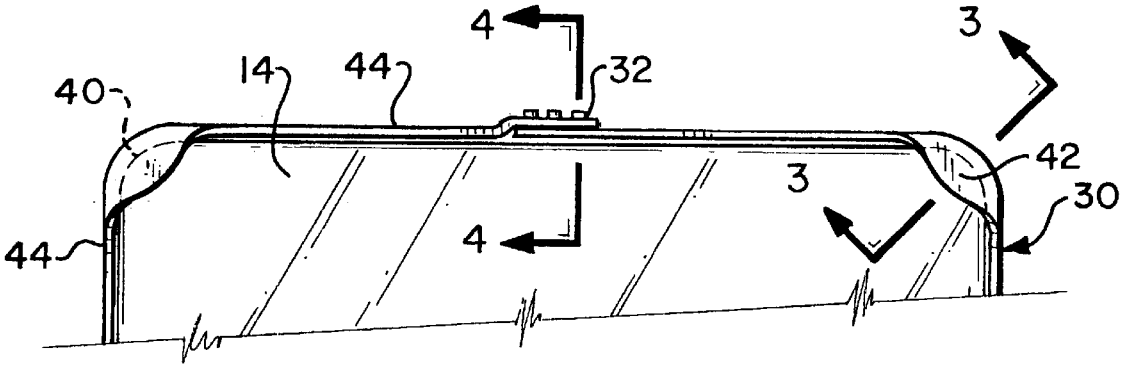
FIG. 2 is a partially broken-away front elevation view of the FIG. 1 tube, showing the implosion prevention band in its installed position.

In FIGS. 1 and 2, a cathode ray tube (CRT) 10, such as a color television picture tube or a monitor, is shown which includes an evacuated glass envelope 12. The envelope 12 comprises a rectangular glass faceplate panel 14, a cylindrical neck 16, and an interconnecting funnel 18. The neck 16 is closed at its distal end with a stem enclosed within the base 20. An electron gun (not shown) is housed within the neck 16 and connects to base prongs 22, which are supported and extend externally from the stem 20. The neck 16 is sealed to and closes the small end of the funnel 18. The faceplate panel 14 has a front viewing surface 24 and includes an integral, rearwardly extending glass sidewall 26 extending continuously around the faceplate panel 14 and generally parallel to the tube axis Z-Z. The faceplate panel 14 closes and is sealed to the wide end of the funnel 18 along the seal line 28 (shown in FIG. 3) at the terminal end of the sidewall 26. The basic shape of the envelope viewing surface 24 may be either rectangular or square in plan as conventionally known in the art.

The interior of the envelope 12 is evacuated to a high level of vacuum causing high tensile stresses near the viewing surface 24 of the faceplate panel 14 and adjacent portions of the sidewall 26 and funnel 18. An implosion prevention band 30 of a thin walled high-tensile strength material such as steel encircles the outer surface of the sidewall 26 of the faceplate panel 14 as will be described in greater detail in view of FIGS. 3 and 4. The ends of the band 30 are overlapped and connected together at joint 32 to form a closed band. The ends of the band 30 can be permanently joined by welding, riveting, crimping or otherwise connected as is known in the art. In FIGS. 1 and 2, riveting is the illustrated technique. Preferably the band 30 is a cold-rolled steel material having a width between about 0.50 and 3.00 inches and a thickness between about 0.03 and 0.20 inches. After the band 30 is properly formed and the ends are joined, it is expanded by heating and placed over and around the exterior surface of the sidewall 26. The band 30 is permitted to cool in place to contact the surrounding exterior surfaces of the sidewall 26 so the band 30 develops tensile stresses and in turn develops counteracting compressive stresses in the glass surface therebeneath. This force of the band 30 essentially pre-stresses the glass of the faceplate panel 14 in a direction to counteract the force on the faceplate panel caused by stresses produced by the vacuum inside the tube and by the atmospheric pressure acting on all surfaces of the CRT.

Figure 3:
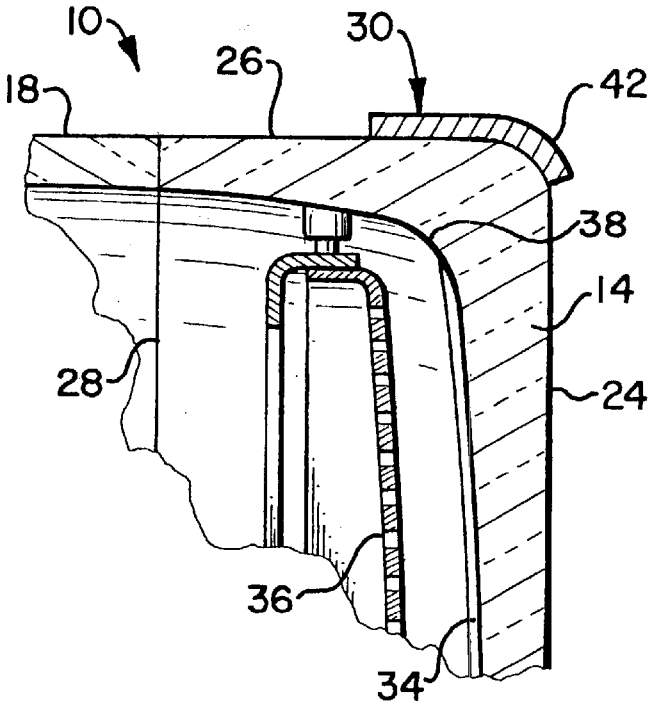
FIG. 3 is an enlarged partially broken-away side view taken along the line 3—3 of FIG. 2.

FIG. 3 shows for illustration a cross-sectional view of the CRT according to the present invention taken along line 3—3 of FIG. 2. A luminescent screen 34 which is made up of luminescent phosphor deposits is located on the interior surface of the panel 14. A mask 36 being held flat and having a predetermined pattern of apertures is supported in any known manner with its peripheral portion secured to the sidewall 26. With the mask 36 so positioned, the apertures of the mask 36 are registered with, and patterned relative to, the phosphor deposits on the luminescent screen 34.

The interior surface of the faceplate panel 14 and intersecting inner surface of the sidewall 26 form an inside blend radius 38 around the inner periphery of the faceplate panel 14. The band 30 has rounded corner portions 40 which include an inwardly turned lip portion 42. The inside radius of curvature of the rounded corner portions 40 is substantially equal to the outside radius of the corners of the faceplate panel 14 and preferably extends about 85 degrees around the corner of the faceplate panel 14 (as illustrated in FIG. 2). This rounded corner portion 40 blends into a relatively flattened portion 44 immediately adjacent thereto extending along the straight edge of the sidewall 26.

Figure 4:
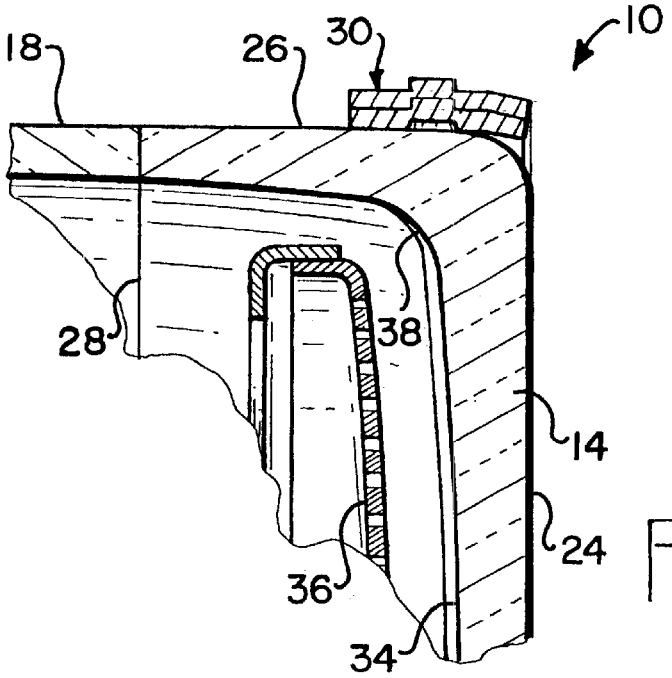
FIG. 4 is an enlarged partially broken-away side view taken along the line 4—4 of FIG. 2.

The lip portion 42 extends toward the viewing surface 24 and closely conforms to at least an edge of the external surface of the intersecting corner regions of the faceplate panel 14 and sidewall 26. The given radius of curvature of the lip portion 42 is preferably in the range of 60 to 75 degrees prior to reaching the positional location whereat the corner portion 40 blends into the relatively flattened portion 44. As shown in FIG. 4, the flattened portion 44 of the band 30 extends generally parallel to the outer flat surface of the sidewall 26 with the leading edge of the flattened portion 44 extending generally tangentially from the curved surface formed along the intersection edges of the faceplate panel 14 and sidewall 26 and is preferably behind or in alignment with the viewing surface 24 of the faceplate panel 14. The width of the band 30 extends aft of the viewing surface 24 along the outer surface of the sidewall 26 and terminates at or near the intersection of the inside blend radius 38 and the inner surface of the sidewall 26.

A single or double bonded vinyl, fiberglass, or friction tape (not shown) may be placed beneath the band 30 in order to prevent scratching of the outer surface of the sidewall 26 and to add to the adherence of the band 30 at the corners and thus helps to maximize the tension along the flattened portion 44 of the band 30. Accordingly, as the band 30 shrinks during installation optimum compression forces are applied to the corners of the tube near and forward the inside blend radius 38 of the faceplate panel 14 so as to maximize the compressive forces near the viewing surface 24 at the corners of the faceplate panel 14. The reduction in surface area contact by the band 30 aft of the intersection of the inside blend radius 38 and sidewall 26 not only reduces the compressive forces on the sidewall 26 thereby preventing flexing of the sidewall 26 but, more importantly the tightening force by the band 30 will more effectively be applied to the faceplate panel substantially near the viewing surface 24 especially at the corners of the faceplate panel 14. The compressive forces applied near and forward the inside blend radius 38 by the band 30 effectively pre-stresses the faceplate panel 14 so as to the counteract the tensile stresses on the faceplate panel 14 caused by the vacuum and atmospheric pressure on the tube thus maximizing the impact resistance of the tube.

It has been found that the corner regions near the intersection of the sidewall 26 and faceplate panel 14 are particularly susceptible to high tensile stresses in a flatter panel and thus subject to failure and implosion whenever the tube envelope is shocked. Placement of the band 30 at or near the inside blend radius 38 in accordance with the present invention provides increased compressive forces near the viewing surface 24 in the corner regions of the faceplate panel 14 thereby improving the effect of the band 30. Moreover, this failure characteristic at the corner regions can be minimized and the implosion resistance enhanced by increasing the glass thickness at the corner regions of the faceplate panel 14 to insure that the tightening forces applied by the band 30 is effectively applied at or near the inside blend radius 38 and distributed near the viewing surface 24 in the corner regions of the faceplate panel 14.

The present invention may be applied to any CRT that has a faceplate panel with reduced curvature for which it is desirable or necessary to reinforce in order to improve its resistance to implosion. The reinforced CRT finds its greatest use as a color television picture tube.

What is claimed is:

1. An implosion preventive band for a cathode ray tube comprising: an evacuated envelope including a funnel and a faceplate panel having a viewing surface, rounded corners and sidewalls joined to said funnel, said faceplate panel and sidewalls forming outside intersecting corner regions at the corners of said panel and an inside blend radius around the inner periphery of the faceplate panel; and, a band having rounded corner portions, said band surrounding said sidewall and extending along the exterior surface of said sidewall such that the width of the band terminates near said inside blend radius, said band being under tension to produce radially inwardly directed force components on said faceplate panel near said inside blend radius.

2. An implosion prevention band of claim 1 wherein the corner portions of said band have a radius substantially equal to the outside radius of the rounded corners of said faceplate panel.

3. An implosion prevention band of claim 1 wherein said viewing surface is generally flat.

4. An implosion prevention band of claim 1 wherein the corner portions of said band extends about 85 degrees along the outside radius of the rounded corners of said faceplate.

5. An implosion prevention band of claim 1 wherein said width of said band extends along the exterior surface of said sidewall and terminates at the intersection of said inside blend radius and said sidewall.

6. An implosion prevention band of claim 1 wherein said width of said band extends along the exterior surface of said sidewall and terminates forward of the intersection of said inside blend radius and said sidewall.

7. An implosion prevention band of claim 1 wherein said rounded corner portions of said band further comprises lip portions extending therefrom, said lip portions conform to at least a portion of said intersecting corner regions of said faceplate panel and sidewall.

8. An implosion prevention band of claim 7 wherein said lip portions of said corner portions conform to said intersecting corner regions and extend along said corner region within a radius of curvature of about 60 to 75 degrees toward said viewing surface.

9. An implosion prevention band for a CRT having an evacuated glass envelope comprising:

a hollow funnel; a faceplate panel of a predetermined thickness and having a substantially rectangular shaped exterior viewing surface with rounded corners, said faceplate panel having a given radius of curvature extending into an integral peripheral sidewall having flat sides and sealed to the larger end of said funnel, said faceplate panel forming a peripheral inside blend radius intersecting with the inside surface of said sidewall; and, an implosion prevention band having rounded corner portions and surrounding and conforming to the exterior peripheral surface of said sidewall wherein the width of said implosion prevention band extends from the forward most non-viewing exterior surfaces of said faceplate panel and terminates near said intersection of said inside blend radius and sidewall.

10. An implosion prevention band of claim 9 further comprising a lip portion extending from said rounded corner portions toward said viewing surface on said given radius of curvature and prior to said flat sides of said sidewall.

11. An implosion prevention band of claim 9 wherein the thickness of said inside blend radius at the rounded corners of said faceplate panel is greater than the thickness of the contiguous portions of said faceplate panel.

* * * * *